United States Patent [19]

Sabet

[11] 3,953,157

[45] Apr. 27, 1976

[54] ROTARY-PISTON INTERNAL-COMBUSTION ENGINE WITH TWO OUTPUT SHAFTS

[76] Inventor: Huschang Sabet, Eduard-Pfeiffer Str. 67, D-7000 Stuttgart, Germany

[22] Filed: May 28, 1975

[21] Appl. No.: 581,704

[52] U.S. Cl. ..... 418/36; 418/34; 418/37

[51] Int. Cl.[2] ..... F01C 1/00

[58] Field of Search ..... 418/33, 34, 35, 36, 418/37; 123/8.47

[56] References Cited

UNITED STATES PATENTS

| | | | |
|---|---|---|---|
| 1,889,508 | 11/1932 | Zens | 418/36 |
| 3,356,079 | 12/1967 | Rolfsmeyer | 418/36 X |
| 3,736,080 | 5/1973 | Sabet | 418/34 |
| 3,829,257 | 8/1974 | Goering | 418/36 |
| 3,873,247 | 3/1975 | Boes | 418/36 |

FOREIGN PATENTS OR APPLICATIONS

| | | | |
|---|---|---|---|
| 51,534 | 4/1936 | Denmark | 123/8.47 |

*Primary Examiner*—C. J. Husar
*Assistant Examiner*—Leonard Smith
*Attorney, Agent, or Firm*—Hans Berman

[57] ABSTRACT

The rotary-piston engine of U.S. Pat. No. 3,736,080 has two sets of pistons rotatable about a common axis in a casing. One set is attached to the output shaft of the engine for continuous rotation with the same while a motion-transmitting train connects the two sets in such a manner that the pistons of the other set are rotated at cyclically varying speed to expand and contract combustion chambers circumferentially bounded by respective pistons of the two sets. The motion-transmitting train includes crankshafts excentrically mounted on the output shaft and driven by planet gears meshing with an internal ring gear on the engine casing, and connecting rods linking each crank with the second set of pistons. According to this invention, the engine includes a central gear coaxial with the ring gear, meshing with the planet gears, and driving a second output shaft coaxially rotatable in the first-mentioned shaft.

6 Claims, 2 Drawing Figures

ROTARY-PISTON INTERNAL-COMBUSTION ENGINE WITH TWO OUTPUT SHAFTS

This invention relates to rotary-piston internal-combustion engines, and particularly to an improvement of the engine disclosed in my earlier U.S. Pat. No. 3,736,080.

The rotary engine of the patent is suitable for use in automotive vehicles in which a multiple-speed transmission is conventionally provided in the drive train which connects the engine to the wheels of the vehicle. The transmission adds to the bulk and cost of the vehicle.

It has now been found that the engine of my earlier invention is readily modified to provide torque at two different rotary speeds without significantly increasing its bulk and with minimal added expense, thereby eliminating or greatly simplifying the conventional multiple-speed transmission.

The known engine has two sets of pistons mounted for rotation about a common axis while in movable sealing engagement with the engine casing so as to define combustion chambers. A motion-transmitting train connects the pistons of one set to the pistons of the other set for rotating the pistons of the other set at cyclically varying speed when the pistons of the first-mentioned set rotate at uniform speed, and for thereby cyclically expanding and contracting the chambers. A first output shaft is connected to the one set of pistons for simultaneous rotation. The motion-transmitting train includes at least one crank drivingly connected to the output shaft and a connecting rod hingedly connecting the crank to the other set.

The invention provides in such an engine an epicyclic gear train of three elements and a second output shaft. A first gear element of the epicyclic train is fastened to the casing, a second gear element is fastened to the crank and rotatably secured to the first output shaft, and the third gear element is fastened to the second output shaft for rotation therewith, the second gear element simultaneously meshing with the first and third gear elements.

Figure 1:
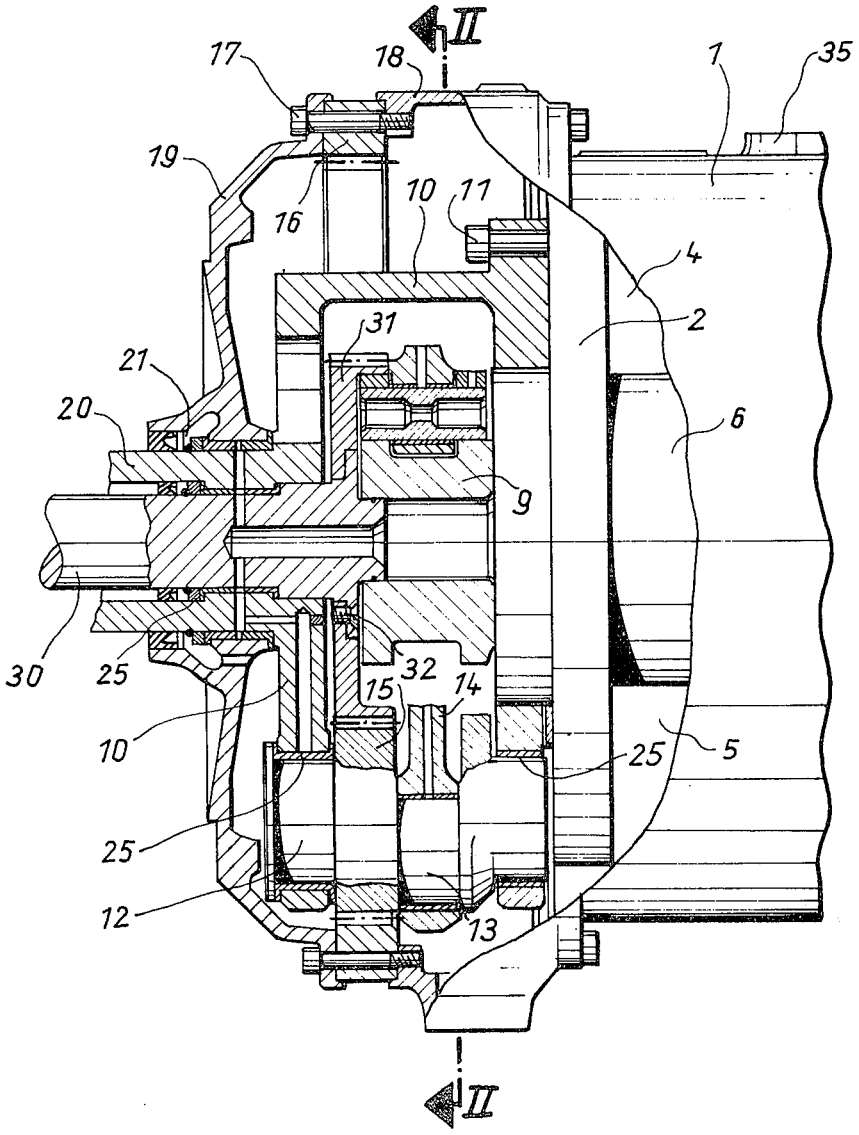
Figure 2:
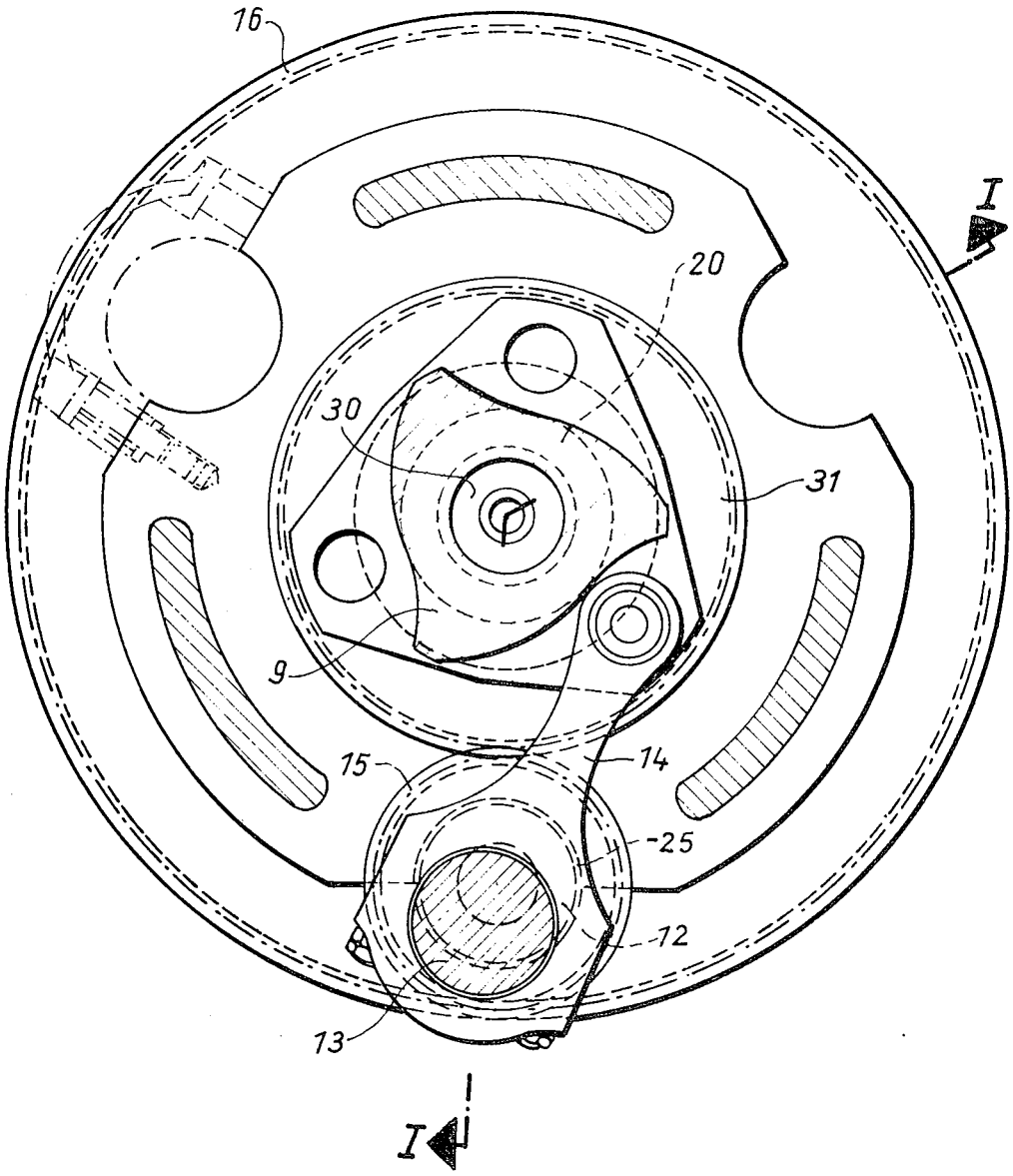

Other features, additional objects, and many of the attendant advantages of this invention will readily be appreciated as the same becomes better understood by reference to the following detailed description of a preferred embodiment when considered in connection with the accompanying drawing in which:

FIG. 1 shows an internal combustion engine of the invention in section on the line I — I in FIG. 2; and FIG. 2 illustrates the engine of FIG. 1 in fragmentary section on the line II — II.

The drawing shows only as much of the engine described and illustrated in the afore-mentioned patent as is necessary for an understanding of this invention, the disclosure of the patent being incorporated herein by reference.

The illustrated rotary piston engine has a combustion space bounded in a radially outward direction by a cylindrical casing wall 1, and in two axial directions by radial, annular end walls 2 of which only one is seen in the drawing. The two end walls are fixedly connected by four pistons 4 equiangularly distributed about the axis of the casing 1, hereinafter referred to as the engine axis, to form a first set of pistons. In normal operation of the engine, the casing 1 is stationary, and the pistons 4 together with the end walls 2 rotate at uniform speed about the engine axis.

The combustion space is bounded in a radially inward direction by the outer face of a mounting sleeve 6 which is rotatably sealed in the end walls coaxial with the casing 1 and constitutes a second set of pistons with four equiangulary spaced pistons omitted from the drawing in order not to crowd the same, the arrangement of pistons on the sleeve 6 being shown in FIG. 2 of the patent. The sleeve 6 is fixedly mounted on a coaxial tumbler shaft 9.

The planet carrier 10 of an epicyclic train is fixedly fastened to the end wall 2 by means of screws 11. Three identical cranks including crankshafts 12 are equiangularly spaced on the carrier 10 about the engine axis, each shaft being journaled in two axially spaced bearings 25 on the carrier 10. The crankpin 13 of each crankshaft carries a connecting rod 14 whose free end is hingedly fastened to the enlarged head of the shaft 9. Only portions of two connecting rods and of associated crank structure are shown in FIG. 1, and only one crank arrangement is illustrated in FIG. 2. A planet gear 15 fixed on each crankshaft 12 meshes with an internal ring gear 16 attached by screws 17 to a cylindrical gear housing 18 which is fixedly fastened to the casing wall 1. A generally radial cover 19 is attached to the housing 18 by the screws 17.

The structure described so far is closely similar to features of the engine disclosed in the afore-mentioned patent and functions in the same manner. When the carrier 10 and the pistons 4 rotate at uniform speed, the shaft 9, the mounting sleeve 6, and the non-illustrated pistons attached to the sleeve oscillate relative to the pistons 4 to expand and contract combustion chambers which are each bounded circumferentially by respective faces of a piston 4 and of a piston mounted on the sleeve 6. A fuel mixture is admitted to each combustion chamber through ports of the casing wall 1 in a manner well known in itself, and the mixture is ignited in the proper sequence by a non-illustrated spark plug, whereupon the spent fuel mixture is discharged through exhaust ports in the casing wall, only one port 35 being partly indicated on the casing 1 in FIG. 1. The sequentially exploding portions of the fuel mixture porduce the torque for turning the pistons 4, the end walls 2, and the gear carrier 10 at uniform speed whereas the rotary speed of the sleeve 6 varies cyclically between values smaller and greater than the speed of the gear carrier 10.

A tubular, cylindrical hub portion 20 of the gear carrier 10 is journaled in a bearing 21 in the cover 19 for rotation about the engine axis. The hub portion 20 thus constitutes a first output shaft of the engine. A second output shaft 30 is coaxially mounted in the bore of the hub portion 20 in a bearing 29, and its axial end portions project from the hub portion 20 in both directions, only one end portion being seen in FIG. 1. It is journaled in an axially open recess of the tumbler shaft 9. A spur gear 31 which is the central element of the afore-mentioned epicyclic train and meshes with the three planet gears 15 is attached to the second output shaft 30 by screws 32. The two shafts 20, 30 thus rotate at different speeds while the engine operates and may be coupled alternatively to the driven wheels of a vehicle or other driven devices in a manner too well known to require more detailed description.

What is claimed is:

1. In a rotary-piston, internal-combustion engine having a casing, two sets of pistons mounted for rotation about a common axis while in movable sealing engagement with said casing so as to define chambers therebetween, motion-transmitting means connecting the pistons of one set to the pistons of the other set for rotating the pistons of said other set at cyclically varying speed when the pistons of said one set rotate at uniform speed and for thereby cyclically expanding and contracting said chambers, and a first output shaft connected to said one set for simultaneous rotation, said motion-transmitting means including a crank drivingly connected to said output shaft and a connecting rod hingedly connecting said crank to said other set, the improvement which comprises:

a. an epicyclic gear train including a first gear element fixedly fastened to said casing, a second gear element fastened to said crank and rotatably secured to said first output shaft, and a third gear element, said second gear element simultaneously meshing with said first and third gear elements; and b. a second output shaft fastened to said third gear element for rotation therewith.

2. In an engine as set forth in claim 1, one of said output shafts being tubular and coaxially receiving the other output shaft.

3. In an engine as set forth in claim 2, a portion of said casing enclosing said epicyclic gear train, said output shafts projecting from said portion of said casing.

4. In an engine as set forth in claim 3, said first gear element being an internal ring gear, and said second gear element being radially interposed between said first and third gear elements.

5. In an engine as set forth in claim 4, a gear carrier fixedly fastened to said first output shaft and to said one set for drivingly connecting said one set to said first output shaft, a portion of said gear carrier being interposed between said gear train and said portion of said casing in the direction of said common axis and rotatably carrying said second gear element.

6. In an engine as set forth in claim 5, said one set defining a recess centered in said common axis and open in an axial direction, one of said output shafts being journaled in said recess for rotation about said axis.

* * * * *